United States Patent [19]

LeStrange et al.

[11] Patent Number: 4,514,492

[45] Date of Patent: Apr. 30, 1985

[54] ELIMINATION OF DEFECTS IN CYSTEINE-SENSITIZED EMULSIONS

[75] Inventors: Raymond J. LeStrange; John H. Bayless, Jr., both of Hendersonville; Allan R. Schoenberg, Asheville, all of N.C.

[73] Assignee: E. I. Du Pont de Nemours and Company, Wilmington, Del.

[21] Appl. No.: 561,525

[22] Filed: Dec. 15, 1983

[51] Int. Cl.[3] ..... G03C 1/34; G03C 1/28

[52] U.S. Cl. ..... 430/600; 430/603; 430/607; 430/613; 430/614; 430/523; 430/935

[58] Field of Search ..... 430/600, 603, 607, 613, 430/614, 935, 523

[56] References Cited

U.S. PATENT DOCUMENTS

| | | | |
|---|---|---|---|
| 2,449,153 | 9/1948 | Urbach | 430/603 |
| 3,446,618 | 5/1969 | Dersch et al. | 430/613 |
| 3,565,625 | 2/1971 | Scavron | 430/600 |
| 3,660,092 | 5/1972 | Frank | 430/543 |
| 3,708,302 | 1/1973 | Plakunov et al. | 430/600 |
| 4,243,748 | 1/1981 | Elsner et al. | 430/600 |
| 4,340,665 | 7/1982 | Sidwell | 430/607 |

*Primary Examiner*—Won H. Louie

[57] ABSTRACT

Desensitization defects due to nonferrous metal contamination of a silver halide film sensitized by a cysteine-thiazolidine moiety are decreased by incorporating a chelating agent such as quinaldic or picolinic acid into one or more layers of the film.

9 Claims, No Drawings

ELIMINATION OF DEFECTS IN CYSTEINE-SENSITIZED EMULSIONS

FIELD OF THE INVENTION

The invention pertains to silver halide photographic films which on development exhibit desensitization due to metal contamination. In particular the invention pertains to cysteine and/or thiazolidine-sensitized emulsions protected against desensitization due to aluminum, copper, or zinc.

BACKGROUND OF THE INVENTION

The prior art discloses a number of new ways to increase the sensitivity of photographic silver halide emulsions. Urbach, U.S. Pat. No. 2,449,153, discloses an emulsion containing cysteine. Scavron, U.S. Pat. No. 3,505,025, discloses the use of thiazolidines in photographic films. Plakunov and Koller, U.S. Pat. No. 3,708,302, discloses that the reaction product of cysteine and glutaraldehyde can be employed in a layer on the same side of the support as a silver halide emulsion layer. Elsner, et al U.S Pat. No. 4,243,748. describes the combination of a thiazolidine-compound and a disulfide. Thus, over the years it has come to be recognized that the sensitivity of silver halide films could be increased by incorporating a cysteine or thiazolidine moiety in one or more layers. However, there is a problem of metal contamination.

It is generally known that chelating agents may be added to a photographic element to control or eliminate defects caused by metal contamination. A chelating agent forms a stable complex with undesirable metal ions to prevent them from interfering with the silver imaging process. Sidwell, U.S. Pat. No. 4,340,665, describes a synergistic combination of chelate and phosphate for counteracting iron contamination in silver halide films. Earlier references have described various amine and quinoline chelating agents for use in photographic emulsions and photographic developers to avoid problems with iron contamination.

Quinoline compounds are also known to be useful in photographic films for purposes other than chelates for undesirable metal ions. Jones et al. U.S. Pat. No. 2,578,655, discloses improved image color with 4-hydroxyquinolines. Dersch et al. U.S. Pat. No. 3,446,618, describes the use of a 4-hydroxyquinoline carboxylic acid salt as a stabilizer.

It has now been discovered that severe development artifacts which occur in photographic films containing AgIBr emulsions sensitized with cysteine and/or thiazolidine moieties due to nonferrous contamination, viz., Al, Cu, or Zn, can be substantially reduced or eliminated by the incorporation of chelating agents in one or more layers of the film.

SUMMARY OF THE INVENTION

The object of the present invention is the elimination or reduction in severity of development artifacts caused by nonferrous metal contamination in films containing a silver halide emulsion sensitized with a cysteine and/or thiazolidine moiety. This object is achieved by incorporating within the film structure a chelating agent such as a quinoline or amine compound which is believed to function by forming a high formation constant for Al, Cu, or Zn. Thus, if the nonferrous metals are tied up as chelates, the cysteine-thiazolidine moiety performs its useful function of increasing sensitivity and cannot interact to produce desensitization. A chelating agent with a high energy of formation, i.e., higher than that of a cysteine-thiazolidine chelating agent, is believed to form a complex with the nonferrous metal contaminant which is stronger than a complex which would be formed between a cysteine or thiazolidine moiety and the nonferrous metal contaminant.

This invention is directed to a process of coating a gelatino-silver halide emulsion sensitized with cysteine and/or thiazolidine type compounds on a support having at least one subbing layer, and, optionally, overcoating with an auxiliary layer, in which process the emulsion is subject to desensitization by nonferrous metal contamination, wherein the improvement comprises incorporating in one or more of the subbing, emulsion, or auxiliary layers a quinoline, ethylenediamine, ethanoldiglycine, or acid chelating agent in amounts sufficient to complex nonferrous metals. Chelating agents which are effective when added in from 10 mg to 20 g per mole of silver halide emulsion include the following: quinaldic acid, 8-acetoxyquinoline, ethylenediamine-N,N'-bis (hydroxyphenyl)acetic acid, sodium N,N'-ethylene bis (2,5-sodium sulfocarbolate) glycinate, 5,7-dibromo-8-quinolinol, N-phenylbenzohydroxamic acid, oxalic acid, 8-hydroxyquinoline-5-sulfonic acid, trisodium N-hydroxyethylethylenediaminetriacetate, picolinic acid, dipicolinic acid, 8-hydroxyquinoline, 2-pyrazinecarboxylic acid, 2,3-pyrazinedicarboxylic acid, 3,5-pyrazoledicarboxylic acid, pyrrole-2-carboxylic acid, 2,3-pyridinecarboxylic acid, 2,4-pyridinecarboxylic acid, and 2,5-pyridine carboxylic acid.

One particularly useful application of the present invention involves the incorporation of the chelating agent into the gelatin subbing layer on a support in order to prevent desensitization defects originating from metal contamination on the support; whereas another involves the incorporation of the chelating agent into an antiabrasion layer over the emulsion layer to prevent desensitization defects originating during handling of the film.

DETAILED DESCRIPTION OF THE INVENTION

Cysteine and L-thiazolidine-4-carboxylic acid are representatives of the cysteine-thiazolidine moiety, having the following structures:

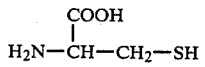

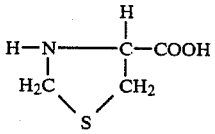

Other representatives of this moiety include 2-aminoethanethiol (cysteamine), L-cysteine ethyl ester, L-cysteine methyl ester, and thiazolidine.

A common feature of the moiety is the special configuration of three silver complexing agents, i.e., the sulfur, amine, and carboxylic acid groups. Thus the possibility exists for a cysteine-thiazolidine moiety to bind with silver via three different groups to form the following generalized structure:

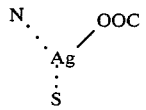

Regardless of the mechanism the cysteine-thiazolidine moiety has been demonstrated to be effective in increasing the sensitivity of photographic film, regardless of whether the cysteine-thiazolidine addition is made to the emulsion layer, or to a layer adjacent to the emulsion layer.

In concept, the sensitivity increase attributable to the incorporation of a cysteine-thiazolidine moiety in a photographic film appears to be the result of a chemical interaction with sensitivity centers and/or latent image centers on the silver halide grains. The formation of a cysteine-thiazolidine complex with silver is believed to intensify sensitivity centers and/or stabilize latent image centers. Higher sensitivity is observed in developed film containing the cysteine-thiazolidine moiety, versus a developed film without such addition, due to the higher number of developable latent images resulting from intensification and/or stabilization.

From what was known about cysteine-thiazolidine sensitized emulsions it was a completely unexpected result to find that nonferrous metals such as aluminum copper and zinc could not only negate the sensitivity increase, but in fact could create severe desensitization when these metals contaminated the film. It was discovered, in the course of producing films sensitized with various cysteine and thiazolidine moieties, that iron was not responsible for such developed artifacts. These films were observed to be susceptible to nonferrous metal contamination in the form of "whitetails" and "fingerprints". Whitetails are comma or commet shaped areas of desensitization which are due to metal contamination of the support by the environment. Fingerprints result, as the name implies, from finger contact, whereby metal contamination of the overcoat layer of the film produces desensitization. Zinc represents a significant metal found in finger perspiration, because fingers pick up metals by contact with a variety of objects such as coins, brass doorknobs, aluminum cookware, etc. For both whitetails and fingerprints the desensitization was many degrees of magnitude greater than the sensitivity increase attributable to the incorporation of cysteine and/or thiazolidine compounds in the film structure.

The source of the nonferrous metal contamination creating the severe desensitization in cysteine and/or thiazolidine sensitized emulsions can also originate from a variety of mechanical and electrical devices employed in the manufacture and handling of both the support and the film. Motor bearings, static devices, control equipment, and transport equipment are some of the potential sources of such nonferrous metal contamination. Microscopic particles of aluminum, copper and zinc can thus be produced by friction during high speed manufacture and subsequent human and machine handling of photographic film.

The following examples serve to illustrate the practice of the present invention wherein from 10 mg to 20 g per mole of silver halide of a chelating agent was added to one or more layers of a silver halide film containing a cysteine and/or thiazolidine sensitized emulsion to reduce or eliminate desensitization defects.

EXAMPLE 1

A high speed gelatino-silver iodobromide emulsion (1.2% Iodide) was coated on a portion of gelatin-subbed polyethylene terephthalate support, other portions of which had demonstrated desensitization spots with previous coatings. Portions of this same emulsion received additions of cysteine hydrochloride and 8-hydroxyquinoline before being coated on the same support. Per 1.5 mole of silver halide the 8-hydroxyquinoline additions were 0.24, 0.48 and 0.72 g (3 samples). All coatings were overcoated with a gelatin antiabrasion layer containing chrome alum and formaldehyde hardeners.

Duplicate tests were run on a prior art control without cysteine sensitization, on the cysteine-sensitized control, and the three samples of 8-hydroxyquinoline addition to cysteine-sensitized emulsion. Samples were exposed with a Cronex® sensitometer (available from Du Pont Photo Products) and developed in a medical X-ray developer. Numerous developed samples were examined to determine the incidence of desensitized whitetails in these films.

Table 1 contains a summary of these results.

TABLE 1

| Film | Cysteine* | 8-Hydroquinoline* | Average Whitetails per 12" Sheet: Original Test | Average Whitetails per 12" Sheet: Duplicate Test |
|---|---|---|---|---|
| Prior Art Control | — | — | 1.2 | 4.0 |
| Cysteine Control | 0.02 | — | 12.8 | 13.8 |
| Exp. 1 | 0.02 | 0.24 | 3.0 | 4.0 |
| Exp. 2 | 0.02 | 0.48 | 3.4 | 3.0 |
| Exp. 3 | 0.02 | 0.72 | 1.4 | 1.2 |

*g/1.5 mole AgBr

As indicated in the table the addition of a cysteine moiety to the emulsion produced a high level of whitetail defects. The further addition of 8-hydroxyquinoline to the emulsion dramatically reduced the defect level to equal or below that of the prior art control which did not contain the cysteine sensitization.

EXAMPLE 2

The cysteine-sensitized emulsion of Example 1 was coated on four portions of gelatin-subbed support. One portion was overcoated with a control gelatin antiabrasion layer and served as a control. Three portions were overcoated with a gelatin antiabrasion layer containing 8-hydroxyquinoline in an amount of 0.88, 2.64 and 6.60 mg per square meter.

Samples of 35 mm strips of these films were tested in triplicate by rubbing a cotton swab dipped in 0.01 M $CuSO_4$ on the film surface prior to flashing to a 1.0 density and developing. A Quantascan measurement was made of the density difference between the swabbed and unswabbed regions. The sensitometry of these films was tested over a 10 month period and the films containing 8-hydroxyquinoline in the antiabrasion layer were equivalent to the control.

Table 2 contains comparative data for the films.

TABLE 2

| Film | 8-Hydroxy quinoline | Desensitization Ave. 3 Strips | Rel. Speed | Rel. Gradient | Base + Fog |
|---|---|---|---|---|---|
| Con- | — | .079 | 100 | 2.97 | .23 |

TABLE 2-continued

| Film | 8-Hydroxy quinoline | Desensitization Ave. 3 Strips | Rel. Speed | Rel. Gradient | Base + Fog |
|---|---|---|---|---|---|
| trol | | | | | |
| 1 | .88 | .023 | 95 | 2.98 | .24 |
| 2 | 2.64 | .037 | 91 | 2.97 | .20 |
| 3 | 6.60 | .017 | 100 | 2.95 | .21 |

As shown, the controls and experiments all have comparable sensitometric properties, but the desensitization due to the contamination by copper has been considerably diminished by the 8-hydroxyquinoline addition.

EXAMPLE 3

Results similar to Example 2 were obtained with tests using aluminum chloride or zinc nitrate solutions.

EXAMPLE 4

A sample of gelatin-subbed polyethylene terephthalate support was selected for testing based upon prior testing which showed very low levels of whitetail desensitization spots when coated with a cysteine-sensitized iodobromide emulsion. Portions of this support were sprayed with fine droplets of 0.01 M solutions of iron, copper, zinc and aluminum ions and allowed to dry. Thus, samples of support were prepared in which impurity ions had been introduced on the surface similar to the spot pattern observed with a defect prone support.

Samples of both the sprayed and unsprayed support were coated with the control emulsion of Example 1. Exposed and developed samples showed no evidence of desensitized spots corresponding to the spraying.

Samples of both the sprayed and unsprayed support were coated with the cysteine-sensitized emulsion of Example 1. Exposed and developed samples of the unsprayed control and the iron solution showed no defect pattern; but the effect of copper, zinc and aluminum in producing the desensitized defect was clearly evident.

This experiment clearly established that nonferrous metals were responsible for the desensitization with cysteine-sensitized emulsions.

EXAMPLE 5

The same desensitization patterns as in Example 4 were obtained when a support sprayed with copper, zinc or aluminum ions was coated with an emulsion containing 0.0012 g per 1.5 mole of silver halide of thiazolidine-4-carboxylic acid. Similar results were obtained when the thiazolidine-4-carboxylic acid was added to the overcoat instead of directly to the emulsion.

EXAMPLE 6

A polyethylene terephthalate support was prepared as taught by Alles in U.S. Pat. No. 2,779,685 and a resin subbing layer of vinylidene chloride-itaconic acid was applied as taught by Rawlins in U.S. Pat. No. 3,567,452. A gelatin-subbing layer was applied to a portion of this resin-subbed support and served as a control.

Portions of gelatin subbing solution received additions of 8-hydroxyquinoline-5-sulfonic acid or picolinic acid such that when the solution was coated on the resin-subbed support the chelating agent concentration was from $1\times10^{-7}$ to $7\times10^{-7}$ moles per sq. dm. The support was overcoated at a coverage of 5 g silver per square meter.

A variety of emulsions were coated on samples of support with both the control gelatin subbing and the experimental gelatin-subbing containing either 8-hydroxyquinoline-5-sulfonic acid or picolinic acid after the support had been sprayed with nonferrous ions as in Example 4.

Exposed and developed samples of films coated on contaminated support showed no evidence or only low level occurrence of the desensitized spots resembling whitetails when no cysteine or thiazolidine compound was incorporated into the emulsion or the overcoat. When films were coated in which the sensitivity was increased by incorporating cysteine and thiazolidine alone and in combination in the emulsion and the overcoat, the desensitization defect was severe in all cases on the control support. However, when the cysteine-thiazolidine sensitized films were coated on the support containing the chelating agent in the gelatin subbing layer, the defect was either absent or at an extremely low level of occurrence.

EXAMPLE 7

Results equivalent to those in Example 6 were obtained using ethylenediamine-N,N'bis(hydroxyphenyl-)acetic acid, sodium N,N'ethylene bis(2,5-sodium sulfocarbolate) glycinate and quinaldic acid.

EXAMPLE 8

A series of experiments was run as in Example 1 in which various chelating agents were tested in cysteine-sensitized emulsions at more than one level. As a result of these tests it was determined that the whitetail defect due to nonferrous metal contamination could be significantly reduced or eliminated by the incorporation of from 10 mg to 10 g per mole of silver halide of the following compounds in addition to 8-hydroxyquinoline and picolinic acid, i.e. quinaldic acid, 8-acetoxyquinoline, ethylene diamine-N,N'bis (hydroxyphenyl-)acetic acid, sodium N,N'-ethylene bis (2,5-sodium-sulfocarbolate) glycinate; 5,7-dibromo-8-quinolinol, N-phenylbenzohydroxamic acid, oxalic acid, 8-hydroxyquinoline-5-sulfonic acid, trisodium N-hydroxyethylethylenediamine-triacetate, and dipicolinic acid.

EXAMPLE 9

A high speed silver iodobromide emulsion (2.0% Iodide) was coated on a portion of gelatin-subbed polyethylene terephthalate support which demonstrated desensitization spots (whitetails) with previous coatings. Portions of this same emulsion received additions of L-cysteine hydrochloride monohydrate, L-thiazolidine-4-carboxylic acid (TCA), and picolinic acid. Per 1.5 mole of silver halide the cysteine additions were 0.019 g and 0.038 g, TCA additions were 0.008 g, 0.016 g and 0.032 g, and picolinic acid additions were 0.10 g and 0.20 g. Duplicate tests were run on prior art controls.

Samples for sensitometry were exposed with a Cronex® sensitometer and developed in a medical X-ray developer. Samples for determining desensitization whitetails were exposed to white light and developed to give a density between 1.0 and 1.3. Table 3 contains a summary of results.

TABLE 3

| Film | Cysteine | TCA | linic Acid | Ave. Whitetails per sq. ft. (Ave. 5 sheets) | Speed | Base + Fog |
|---|---|---|---|---|---|---|
| Control | — | — | — | 0.40 | 191 | .17 |
| Cysteine control | 0.02 | — | — | 6.4 | 246 | .19 |
| Cysteine control | 0.04 | — | — | 20 | 350 | .20 |
| Exp. 1 | 0.02 | — | 0.10 | 0 | 259 | .19 |
| Exp. 2 | 0.04 | — | 0.10 | 0 | 274 | .20 |
| Exp. 3 | 0.02 | — | 0.20 | 0 | 242 | .19 |
| Exp. 4 | 0.04 | — | 0.20 | 0 | 274 | .20 |
| Control | — | — | — | 0 | 201 | .17 |
| TCA control | — | 0.008 | — | 2.4 | 278 | .19 |
| TCA control | — | 0.016 | — | 10 | 273 | .20 |
| TCA control | — | 0.032 | — | 16.4 | 274 | 0.22 |
| Exp. 5 | — | 0.008 | 0.10 | 0 | 231 | 0.18 |
| Exp. 6 | — | 0.016 | 0.10 | 0.2 | 231 | .20 |
| Exp. 7 | — | 0.032 | 0.10 | 0 | 290 | .22 |
| Exp. 8 | — | 0.008 | 0.20 | 0 | 217 | .19 |
| Exp. 9 | — | 0.016 | 0.20 | 0 | 268 | .20 |
| Exp. 10 | — | 0.032 | 0.20 | 0 | 272 | .23 |

As indicated in the table the addition of a cysteine or thiazolidine moiety to the emulsion produced a higher level of whitetail defects along with an increase in speed and fog. Addition of a sufficient amount of picolinic acid to either cysteine or TCA-containing emulsion eliminated whitetails without an adverse effect on speed or fog.

EXAMPLE 10

Experiments were run as in Example 9 except that a 0.022 g per 1.5 mole silver halide level of cysteine was used together with increasing levels of 8-hydroxyquinoline and 8-hydroxyquinoline-5-sulfonic acid (0.5 g. 1.0 g and 2.0 g per 1.5 mole silver halide). Results of tests for whitetails as described in Example 9 showed that 8-hydroxyquinoline-5-sulfonic acid and 8-hydroxyquinoline were both effective in elimination of the whitetail defect.

We claim:

1. In a process of coating a gelatino-silver halide emulsion sensitized with cysteine and/or thiazolidine type compounds on a support having at least one subbing layer, and optionally overcoating with an auxiliary layer, in which process the emulsion is subject to desensitization by nonferrous metal contamination, the improvement comprising incorporating in one or more of the subbing, emulsion, or auxiliary layers a quinoline, ethylenediamine, ethanoldiglycine, or acid chelating agent in amounts sufficient to complex nonferrous metals.

2. The process of claim 1 in which the chelating agent is one or more of: quinaldic acid, 8-acetoxyquinoline, ethylenediamine-N,N'-bis (hydroxyphenyl)acetic acid, sodium N,N'-ethylene bis (2,5-sodiumsulfocarbolate) glycinate, 5,7-dibromo-8-quinolinol, N-phenylbenzohydroxamic acid, oxalic acid, 8-hydroxyquinoline-5-sulfonic acid, trisodium N-hydroxyethylethylenediaminetriacetate, picolinic acid, dipicolinic acid, 8-hydroxyquinoline, 2-pyrazinecarboxylic acid, 2,3-pyrazinedicarboxylic acid, 3,5-pyrazoledicarboxylic acid, pyrrole-2-carboxylic acid, 2,3-pyridinecarboxylic acid, 2,4-pyridinecarboxylic acid, and 2,5-pyridinecarboxylic acid.

3. The process of claim 1 where the emulsion is silver iodobromide.

4. The process of claim 2 in which one or more layers contain 10 mg to 20 g per mole of silver halide of the chelating agent.

5. The process of claim 1 in which the cysteine and/or thiazolidine type compounds are contained in the auxiliary layer.

6. The process of claim 1 in which the chelating agent is contained in a gelatin subbing layer on the support.

7. The process of claim 1 in which the nonferrous metal is aluminum, copper, or zinc.

8. A method of eliminating or reducing desensitization defects due to nonferrous metal contamination of a multilayer silver halide film sensitized by a cysteine-thiazolidine moiety which comprises incorporating a quinaldic or picolinic acid chelating agent into one or more layers of the film.

9. A photographic film comprising a support, a subbing layer on said support, a gelatino-silver halide emulsion layer, and optionally an auxiliary layer, characterized in that the emulsion is sensitized with cysteine and/or thiazolidine compounds present as emulsion and/or auxiliary layer additions, and wherein a chelating agent with a high formation constant for aluminum, copper or zinc is incorporated into one or more of the subbing, emulsion, or auxiliary layers, said chelating agent being present in an amount sufficient to reduce desensitization defects due to nonferrous metal contaminations of said photographic film.

* * * * *